US009245701B2

(12) United States Patent
Thau et al.

(10) Patent No.: US 9,245,701 B2
(45) Date of Patent: Jan. 26, 2016

(54) PRESSURE SWITCH FOR A MOTOR VEHICLE

(71) Applicants: Wolfgang Thau, Gevelsberg (DE); Janine Husemann, Velbert (DE); Petra Hildebrandt, Ratingen (DE)

(72) Inventors: Wolfgang Thau, Gevelsberg (DE); Janine Husemann, Velbert (DE); Petra Hildebrandt, Ratingen (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 55 days.

(21) Appl. No.: 14/316,313

(22) Filed: Jun. 26, 2014

(65) Prior Publication Data

US 2015/0008110 A1 Jan. 8, 2015

(30) Foreign Application Priority Data

Jul. 3, 2013 (DE) ..... 10 2013 107 001

(51) Int. Cl.

| | |
|---|---|
| ***H01H 3/00*** | (2006.01) |
| ***H01H 13/00*** | (2006.01) |
| ***H01H 13/50*** | (2006.01) |
| ***H01H 13/52*** | (2006.01) |
| ***H01H 13/7073*** | (2006.01) |

(52) U.S. Cl.

CPC ..... *H01H 13/50* (2013.01); *H01H 13/52* (2013.01); *H01H 13/7073* (2013.01); *H01H 2221/042* (2013.01); *H01H 2221/058* (2013.01); *H01H 2235/008* (2013.01); *H01H 2239/03* (2013.01)

(58) Field of Classification Search

CPC ..... H01H 3/00; H01H 3/02; H01H 3/12; H01H 3/122; H01H 3/161; H01H 3/162; H01H 3/163; H01H 9/00; H01H 9/20; H01H 9/02; H01H 9/04; H01H 13/00; H01H 13/04; H01H 13/14; H01H 13/20; H01H 13/16; H01H 13/50; H01H 13/56; H01H 13/62; H01H 13/66; H01H 19/04; H01H 19/16; H01H 21/04; H01H 2205/00; H01H 2205/002; H01H 2217/004; H01H 2223/00; H01H 2223/002; H01H 2223/01; H01H 2231/026; H01H 2233/07; H01H 2233/072; H01H 2233/074; H01H 23/06; H01H 25/041

USPC ..... 200/302.1, 302.3, 5, 339, 329

See application file for complete search history.

(56) References Cited

U.S. PATENT DOCUMENTS

| | | | | |
|---|---|---|---|---|
| 6,080,941 | A * | 6/2000 | Yokobori | G05G 9/047 200/4 |
| 6,396,006 | B1 * | 5/2002 | Yokoji | G06F 3/0312 200/11 R |
| 6,963,039 | B1 * | 11/2005 | Weng | H01H 23/06 200/302.1 |

FOREIGN PATENT DOCUMENTS

| | | | |
|---|---|---|---|
| DE | 10 2004 006 939 | B3 | 7/2005 |
| EP | 1 808 877 | A2 | 7/2007 |
| WO | WO 2012/097791 | A1 | 7/2012 |

*Primary Examiner* — Edwin A. Leon
*Assistant Examiner* — Anthony R. Jimenez
(74) *Attorney, Agent, or Firm* — Fay Sharpe LLP

(57) ABSTRACT

An actuating device for actuating a function on a motor vehicle includes a touch surface actuated by a user. The touch surface is arranged in such a way that it can be moved under pressure from a first end position to a second end position. An elastic reset urges the touch surface into the first end position. A contact switch is arranged between the touch surface and a support surface. A guide sleeve and a guide pin guide the touch surface when actuated. When moving the touch surface, the guide pin is moved in an axial direction into the sleeve and is secured against lateral movement in a small diameter section of the pin. However, the guide pin can be tipped in the sleeve about a pivot point in the small diameter section, thus preventing the touch surface from being jammed in the event of a decentralized impact.

8 Claims, 2 Drawing Sheets

PRESSURE SWITCH FOR A MOTOR VEHICLE

BACKGROUND

The invention relates to a pressure switch for a motor vehicle. In particular, the invention relates to a push-button switch, which can be located in the outer area of the motor vehicle, for example, in the area of the hatchback of the motor vehicle. Such push-button switches are used, for example, for opening a vehicle cover.

For example, EP 1 808 877 discloses a push-button switch for a motor vehicle wherein a push-button is pivotally connected with a housing. A micro switch is used for actuating a lock, and multiple snap discs are provided to increase the actuating force for the micro switch.

WO 2012/097791 discloses a housing for a push-button. This switch is provided with a support surface to which a touch surface is swivel-mounted. In addition, at least one spring element has been attached to the support surface for providing a minimum actuating force for the push-button to increase the actuating force with respect to the reset force of the micro switch.

DE 10 2004 006 939 features a push-button with spring-loaded touch surface. There, it is suggested to arrange a switch suspension of the switch by means of the spring function for the touch surface.

Available switching devices involve the problem that there is an increasing request for large touch surfaces to ensure secure and comfortable actuation, wherein the applied actuating force has to be deflected to the switch located underneath the touch surfaces. Especially in motor vehicles, there is a demand for touch surfaces for reasons of comfort and design, which are, for example, integrated in the manufacturer's emblem at the rear end of the motor vehicle. At the same time, the manufacturer's emblem has a touch function. However, it is always considerably larger than an underneath push-button switch, for example, a micro switch. It is the objective of the invention to provide reliable actuation of a switch over a large touch surface.

BRIEF SUMMARY

The objective of the invention is achieved by means of an actuating device with the characteristics of claim 1.

A support surface has to be attached to a motor vehicle, and on the support surface a touch surface is arranged to be actuated by a user. The touch surface is pivotally mounted between two end positions opposite of the support surface, wherein under pressure the touch surface can be moved from the first end position to the second end position. Elastic reset means that are arranged between the touch surface and the support surface push the touch surface into the first, non-actuated end position.

A contact switch is arranged between the touch surface and the support surface and can be actuated in the second end position by pressing the touch surface. The support surface and/or touch surface includes means for limiting the end position of the movement of the touch surface in the first end position. The touch surface projects beyond the contact switch in a place transverse to its actuating direction, resulting in a larger touch surface in relation to the switch.

On the surfaces facing each other, touch surface and support surface comprise guiding means which guide the touch surface when actuated in its movement between the end positions. Each guiding means has a guide sleeve and a guide pin, and the internal contour of the inner opening of the guide sleeve in the direction of inserting the guide pin has at least one section with a minimal diameter and at least one section with a larger diameter so that, when moving the touch surface, the guide pin can be moved in axial direction into the sleeve and is secured against lateral movement in the area of the section with minimal diameter. As a result, it is possible to tip the guide pin in the sleeve about a pivot point in the section with minimal diameter.

According to the invention, it is important to guide the touch surface in its touch actuation. For this purpose, the touch surface comprises guide elements on a surface facing away from the user, which is located opposite of a carrier surface at the motor vehicle. The support surface and the touch surface are connected by means of these guiding means. In addition, provision has been made for reset means which push the touch surface away from the carrier surface into a non-actuated position. Finally, switching devices are arranged between touch surface and carrier surface, for example, a micro switch, so that when actuated the touch surface impacts the micro switch and triggers a switching process.

If the switch area is actuated only centrally and consistently, guiding means in the form of simple cylindrical guide sleeves and guide pins could ensure certain guidance of the enlarged touch surface and a respective movement of the touch surface on the underneath switch.

However, according to the invention, for enlarged touch surfaces it should also be possible to perform decentralized actuation, for example, offset to the right or to the left. With such actuation, customary guides would result in jamming the switch. Therefore, according to the invention, the guide sleeves of the guiding means are designed in such a way that an area with minimal diameter if formed in the inner opening of the guide sleeve. This area with minimal diameter is adjusted to the outer diameter of a guide pin to be inserted in the sleeve. As a result, lateral movements of attaching the pin to the area with minimal diameter are prevented. For this purpose, the minimal diameter can be selected in such a way that an admissible lateral tolerance of, for example, 1-3 mm, remains to the guide pin's outer diameter.

However, it is important for the invention that besides the area of the minimal diameter in the inner opening of the sleeve an area is provided that has a diameter that is larger when compared to the minimal diameter. In this way, an excessive lateral movement of the touch surface is prevented at all times and guidance is ensured in this place, laterally to the actuating direction. However, it is possible that the guide pin is tipped without jamming in the guide sleeve when the touch surface is actuated in decentralized manner.

Unilateral actuation of an enlarged touch surface results in the fact that the directly actuated section of the touch surface is moved in the direction of the support surface. Because of the integral design, the unloaded areas of the touch surface are also moved. However, the axial movement of the touch surface section in the direction of the support surface takes place to a lesser extent. Instead, the touch surface is tipped because of the action of the pressure and reaction of the reset means. However, because of the special design of the guiding means, it is possible to absorb the inclined position of the touch surface in the guide way, without facing the risk that the guide pins are tilting in the guide sleeves. Underneath the touch surface, the switch is arranged in such a way that even with an inclined touch surface, i.e., unilateral actuation, the space between touch surface and switch is reduced to the extent that the switch can be actuated.

Accordingly, the invention-based guidance consisting of guide sleeves and guide pins is suitable to absorb a tilting of the touch surface, to prevent the guide pins from being jammed in the guide sleeves, and to ensure reliable actuation of a switch located underneath the touch surface. In the event of tilting, the area of minimal diameter in the guide sleeve acts as attachment for the inserted guide pins to be able to perform the tilting movement.

At the same time, it is possible to attach the sleeves at the touch surface and the pins to be inserted at the support surface or vice versa, i.e., to attach the sleeves at the support surface and the pins at the touch surface, or even to mix the attachments.

It is preferred that the sleeve has a constriction with minimal diameter in a central, axial area of the sleeve opening in the direction of inserting the guide pin.

In this embodiment, the guide pin is initially inserted in an area with expanded diameter, and then in an area with reduced diameter, before the insertion area expands again below said constriction area.

Then, in an inclined and tilted position, the guide pin can be guided in the expanded area above or below the constriction.

It is advantageous when the minimal diameter of the sleeve opening is at least 5% larger, preferably 10% larger than the diameter of the associated guide pin.

In this case, sufficient tolerance is available for production deviations despite protection against excessive translational motion.

Preferably, when the guide pin is tilted, the internal contour of the sleeve is designed in axial direction in accordance with a roll-off bend of the external contour of the guide pin.

When, during a tilting movement, the internal contour of the sleeve is exactly adjusted to the external contour of the pin, it is possible to ensure at all times that the pin attaches to the internal contour, even in a tilted position. This prevents undesired tolerance when actuating the push-button.

Furthermore, it is advantageous when the internal contour of the guide sleeve is designed in such a way that the tilting of the guide pin is limited to a predetermined angular range, for example, to 30° at the most, preferably to 20° at the most, in relation to the insertion direction of the guide pin. This prevents excessive tilting of the switch and resulting blockage.

DETAILED DESCRIPTION

Figure 1:
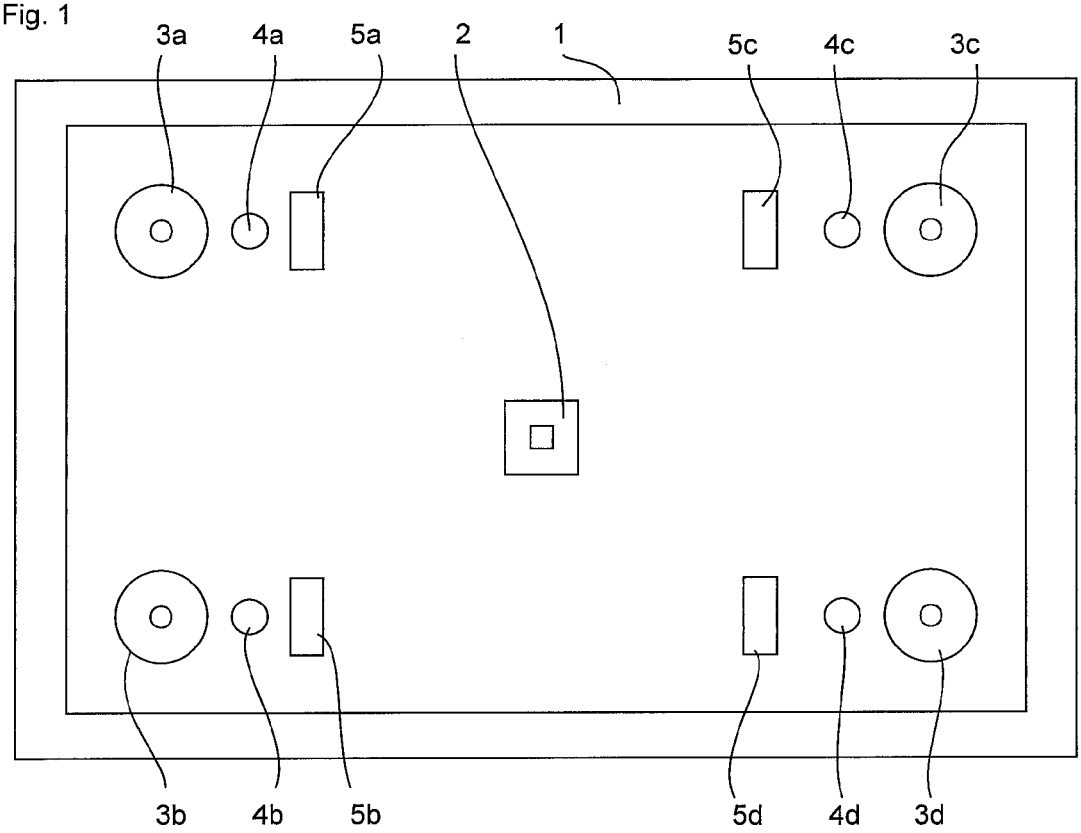
FIG. 1 shows a schematic top view on the first embodiment of an invention-based actuating device without touch surface.

FIG. 1 shows a top view on a first embodiment of an invention-based actuating device. The presentation shows the top view on a support surface 1 with a circumferential frame and a recessed, rectangular inner area. A contact switch 2 is arranged in the center of the inner area. FIG. 1 does not show the touch surface so as not to conceal the elements arranged in the support surface 1.

The contact switch 2 is surrounded by guide sleeves 3*a*, 3*b*, 3*c*, 3*d*. In the embodiment shown, these guide sleeve are designed with a circular cylindrical external circumference and an inner opening. In addition, the area of each guide sleeve is provided with elastic reset means 4*a*, 4*b*, 4*c*, 4*d*. In the embodiment shown, these reset means are designed in the form of elastomer components. Furthermore, means for limiting the end position 5*a*, 5*b*, 5*c*, 5*d* are provided which extend as hook-shaped structures from the support surface 1, namely from its recessed base.

Figure 2:
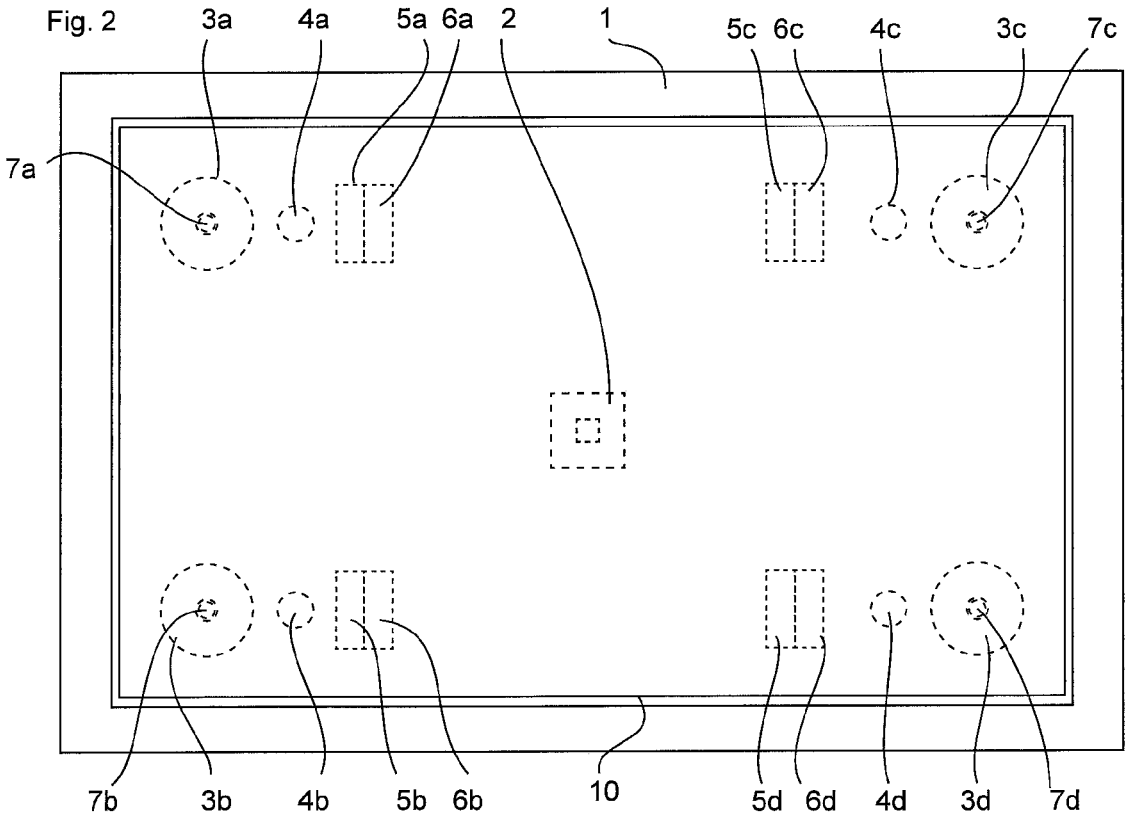
FIG. 2 shows a schematic top view on the first embodiment of an invention-based actuating device with touch surface.

FIG. 2 shows the arrangement with the elements shown in FIG. 1. However, a touch surface 10 has been inserted in the indented recess of the support surface 1. On the rear surface of the touch surface 10, hook portions 6*a*, 6*b*, 6*c*, 6*d* have been arranged which interact with the hooks 5*a*-5*d* to ensure an end position limit of the touch surface 10, which will be explained in the following description.

The reset means 4*a*-4*d* attach to the touch surface and push them into a secured end position, i.e., in the direction of a user of the touch function. In addition, guide pins 7*a*, 7*b*, 7*c*, 7*d* are arranged on the touch surface, which can be inserted in the inner openings of the guide sleeves 3*a*-3*d*.

The presentation shown indicates that basically it has to be possible to actuate the touch surface over its entire surface. The contact switch 2, in this example a micro switch, is located in the center underneath the support surface, so that a movement of the touch surface in the direction of the support surface also results in an actuation of the switch 2. Customary guide ways do not provide sufficient lateral support, so that the touch surface is not sufficiently protected against lateral displacement or they tend to be jammed, so that the guiding means considerably impede or completely restrict the key stroke when the touch surface is operated in unilateral manner.

Figure 3A:
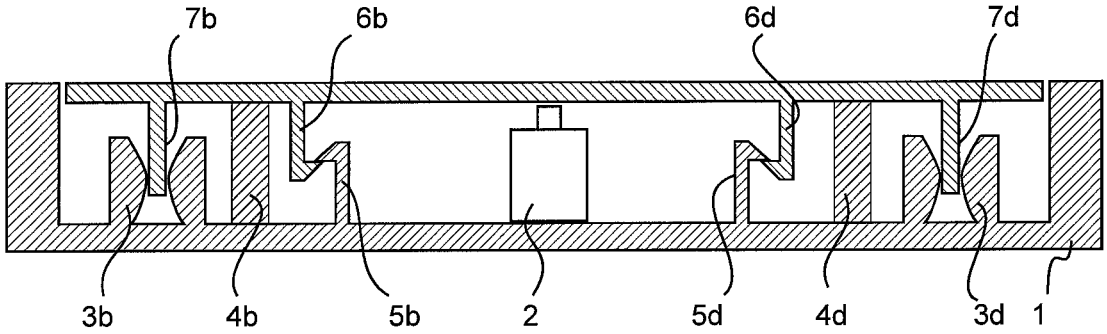
FIGS. 3*a*, 3*b* show a sectional view of the first embodiment in non-actuated and actuated condition.
Figure 3B:
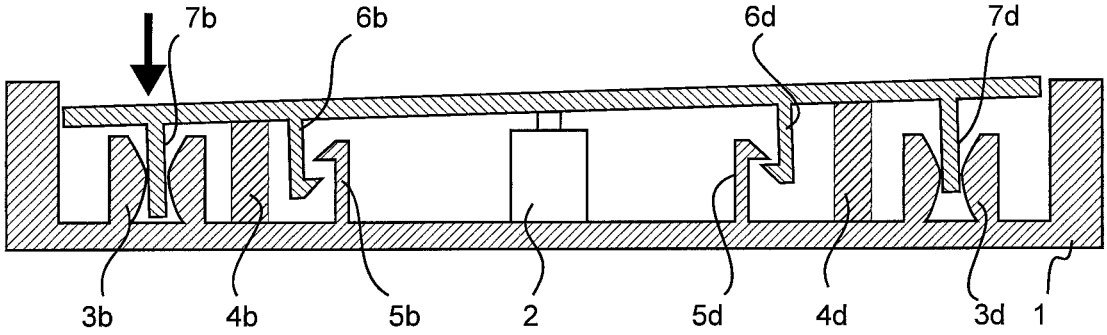

FIGS. 3*a* and 3*b* show a schematic lateral sectional view of the push-button, wherein an intersection was made through the guiding means 3*b* and 3*d*.

By viewing FIGS. 1 and 2 in conjunction with FIGS. 3*a* and 3*b*, it becomes obvious that, on the one hand, the touch surface is pressed by the reset means 4*a*-4*d* into its end position, there it is secured by the end positions 5*a*-5*d* and 6*a*-6*d*, and the guide pins 7*a*-7*d* together with the sleeves 3*a*-3*d* secure the touch surface in its position.

In FIG. 3*a* and FIG. 3*b*, the guide pins 7*b* and 7*d* are inserted in their respective guide sleeve 3*b* or 3*d*. In the example shown, the guide sleeves 3*b* and 3*d* are designed as an integral part of the support surface 1.

Furthermore, it is shown that the internal contour of the guide sleeve is designed in such a way that a section with a minimal diameter secures a respectively inserted guide pin against a translational motion transverse to the direction of insertion. On the other hand, an operation of the touch surface, such as shown in FIG. 3*b*, ensures that the pin cannot be jammed in the sleeve.

Figure 4:
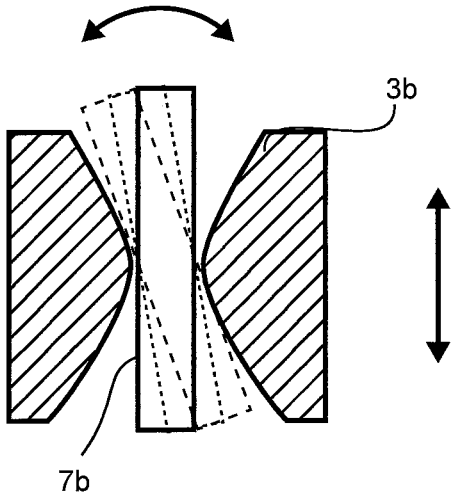
FIG. 4 shows a schematic diagram of the guide way.

FIG. 4 shows that the internal contour of the sleeve provides sufficient space to allow tilting of the guide pin with simultaneous lateral adjustment. It is obvious that even a tilted guide pin allows for further insertion, and the guide pin is still at any time attached or close to the surface of the internal contour of the guide sleeve. Furthermore, the internal contour of the guide sleeve is designed in such a way that the guide pin is able to glide in the contour, i.e., it is designed with smooth and round surfaces.

With reference to FIG. 3*b*, it is clear that even absolutely unilateral actuation would allow for an inclined position of the touch surface and an actuation of the micro switch 2. With this lateral actuation, guide pin 7*b* is inserted considerably deeper than guide pin 7*d*, which results in an inclination of the touch surface 10 in relation to the receiving unit. However, since the guide pins are not jammed in the guide sleeves, after removing the actuating force, the reset means can use the means for limiting the end position to move the touch surface 10 again into its end position.

It is important for the invention that the internal contour and the inner opening of the guide sleeves allow for a tilting movement and that the guide pins can be inserted in tilted condition into the guide sleeves. For example, for this purpose the internal contour can be shaped in the same manner as a roll-off bend of the guide pins. As a result, lateral guidance is provided at all times, as well as an inclination of the guide pins.

In the context of the invention, the means presented can be modified in any desired manner. In particular; less than the four guiding means shown, for example, three, or more than the four guiding means shown can be arranged about a switching element. Furthermore, the means for limiting the end position are provided in the embodiment only for exemplary purposes. Instead of the hook combinations shown, it is also possible to arrange elastic expansion head hubs which can be respectively inserted at the support surface. When assembled, the touch surface is then snapped onto the mountings and by snapping the expansion heads onto the receiving units a respective flexible end position fixation can be guaranteed.

Furthermore, it is also possible to produce the resetting elements from completely different elements. In particular, it is possible to use leaf springs which reset the touch surface in relation to the base. Such leaf springs can consist of plastic material and can be directly injection-molded to the support surface, wherein optionally it is possible to inject a soft component behind the leaf spring in order to improve the reset function. Furthermore, it is possible to combine different spring elements, for example plastic leaf springs and metal spring elements.

The invention claimed is:

1. An actuating device for actuating a function on a motor vehicle, comprising a support surface to be attached to the motor vehicle, a touch surface to be actuated by a user, wherein the touch surface is arranged in such a way that it can be moved in relation to the support surface between two end positions, wherein the touch surface can be moved under pressure from the first end position to the second end position, elastic reset means, which are arranged between the touch surface and the support surface and which push the touch surface into the first, non-actuated end position, a contact switch, which is arranged between the touch surface and the support surface and which can be actuated in the second end position by pressing the touch surface, wherein means for limiting the end position are designed for moving the touch surface into the first end position, wherein the touch surface projects beyond the contact switch in a place transverse to its actuating direction, and the touch surface and support surface comprise interacting guiding means which guide the touch surface when actuated in its movement between the end positions, wherein each guiding means has a guide sleeve and a guide pin, and wherein in the direction of inserting the guide pin the internal contour of an inner opening of the guide sleeve has at least one section with a relatively smaller diameter and at least one section with a relatively larger diameter so that, when moving the touch surface, the guide pin can be moved in axial direction into the sleeve and is secured against lateral movement in the area of the section with the relatively smaller diameter, and the guide pin can be tipped in the sleeve about a pivot point in the section with the relatively smaller diameter.

2. An actuating device according to claim 1, wherein the sleeve has a constriction with the relatively smaller diameter in a central, axial area of the sleeve opening in the direction of inserting the guide pin.

3. An actuating device according to claim 1, wherein the relatively smaller diameter is at least 5% larger, preferably 10% larger than the diameter of the associated guide pin.

4. An actuating device according to claim 1, wherein the relatively smaller diameter is at the most 50% larger than the diameter of the associated guide pin.

5. An actuating device according to claim 1, wherein, when the guide pin is tilted, the internal contour of the sleeve is designed in axial direction in accordance with a roll-off bend of the external contour of the guide pin.

6. An actuating device according to claim 1, wherein the internal contour of the guide sleeve is designed in such a way that the tilting of the guide pin is limited to a predetermined angular range.

7. An actuating device according to claim 6, wherein the predetermined angular range is limited to 30° at the most, in relation to the insertion direction of the guide pin.

8. An actuating device according to claim 7, wherein the predetermined angular range is limited to 20° at the most in relation to the insertion direction of the guide pin.

* * * * *